US006705804B2

(12) United States Patent
Dierker

(10) Patent No.: US 6,705,804 B2
(45) Date of Patent: Mar. 16, 2004

(54) ANCHOR

(75) Inventor: Sascha Dierker, Merching (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/427,633

(22) Filed: May 1, 2003

(65) Prior Publication Data

US 2003/0206774 A1 Nov. 6, 2003

(30) Foreign Application Priority Data

May 6, 2002 (DE) ..... 102 20 116

(51) Int. Cl.[7] ..... E21D 20/02

(52) U.S. Cl. ..... 405/259.5; 405/259.6; 411/82; 411/82.3; 411/950

(58) Field of Search ..... 405/259.5, 259.6, 405/259.1; 411/82, 82.3, 930

(56) References Cited

U.S. PATENT DOCUMENTS 4,194,858 A * 3/1980 Evans ..... 405/259.6
4,704,053 A * 11/1987 Hipkins, Sr. et al. .... 405/259.6
4,709,521 A * 12/1987 Walz ..... 411/82
4,746,248 A * 5/1988 Lillis et al. ..... 405/259.5
5,052,861 A * 10/1991 Hipkins, Sr. ..... 405/259.6
5,076,734 A * 12/1991 Hipkins, Sr. ..... 405/259.5
5,366,328 A * 11/1994 Helderman ..... 411/82
5,525,013 A * 6/1996 Seegmiller et al. ..... 411/82
5,562,377 A * 10/1996 Giannuzzi et al. ..... 411/82
5,984,588 A * 11/1999 Ferrari ..... 405/259.5

* cited by examiner

*Primary Examiner*—Frederick L. Lagman
(74) *Attorney, Agent, or Firm*—Sidley Austin Brown & Wood, LLP

(57) ABSTRACT

An anchor, which is secured in a bore with a mortar, has an anchor member (12) located in the bore, a load application member (11) projecting out of the bore, at least one mixing element (13, 13') for mixing components of the mortar, a drive element (20, 20') provided on the anchor member (12) for setting in motion the at least one mixing element (13, 13'), and a trigger (21) for actuating the drive element (20, 20') which automatically sets in motion the mixing member (15) upon actuation of the trigger (21).

8 Claims, 4 Drawing Sheets

ANCHOR

BACKGROUND OF THE INVENTION

1. Field of the Invention

The present invention relates to an anchor that is secured in a bore with mortar and includes an anchor member located in the bore, a load application member, and at least one mixing member for mixing components of the mortar.

2. Description of the Prior Art

An anchor of the type discussed above is disclosed in U.S. Pat. No. 4,655,645. According to this patent, a two-component mortar is mixed upon rotation of the anchor which can be set in motion manually or with mechanized means. For mixing, the anchor has a mixing element arranged in the rear and central region. The mixing element is secured to the anchor and is set in rotation together with the anchor. When the anchor is to be set, a cartridge with a two-component mortar is placed in bore, with the anchor being subsequently driven into the bore. A bore-facing end of the anchor, upon contacting the cartridge, destroys it, and the mortar components flow out of the cartridge. Upon subsequent driving of the anchor in, the components migrate along the anchor stem in a direction toward the bore opening and are mixed with the mixing element that rotates together with the anchor.

A drawback of the known anchor consists in that for mixing the mortar components, the anchor itself should be rotated which can be very time-consuming. Therefore, the system disclosed in U.S. Pat. No. 4,655,645 is not applicable when an anchor is being anchored in a bore by an impact, which is the case with most of modern systems.

Accordingly, an object of the present invention is to provide an anchor of the types described above which would not require rotation of the anchor for mixing the mortar components.

SUMMARY OF THE INVENTION

This and other object of the present invention which will become apparent hereinafter, are achieved by providing in an anchor of the type described above, drive means arranged on the anchor member for setting in motion the at least one mixing element, and trigger means for actuating the drive means which automatically set in motion the mixing element upon actuation of the trigger means.

The advantage of the present invention consists in that it eliminates a need in use of an additional tool such as, e.g., as a drilling tool which, e.g., is coupled to the load application member for setting in motion the mixing element for mixing the mortar components. This elimination of the need for additional tools results in significant saving of time.

Thus, a user can place a foil or cartridge, which contains at least two mortar component in a bore. An anchor, e.g., an anchor rod, together with a mixing element is then pushed into the bore, e.g., by being impacted with a hammer until it reaches the bore bottom. In the process of being pushed into the bore, the anchor destroys the foil or cartridge, with the mortar components filling the bore. The trigger, e.g., a locking pin, safety ring, and the like can then be withdrawn, which automatically leads to rotation of the mixing element which mixes the components of the mortar.

Advantageously, the drive means includes an accumulator of motion energy which is used for driving the mixing element or which supplies the drive with motion energy. The accumulator can be "loaded" with energy during the manufacturing of the anchor by using the trigger means that simultaneously serves as safety means, preventing premature release of the motion energy.

Advantageously, the energy accumulator is formed as a force accumulator in form of a spring which is preloaded already when the anchor is formed. The spring is secured at one of its end to the anchor member and at another of its ends is operatively connected with the mixing element. The attachment to the mixing element can be effected by using, e.g., an intermediate component. This provides for a simple realization of an automotive drive. The spring can be formed as, e.g., a helical spring or a spiral spring.

Advantageously, the anchor member is surrounded by a sleeve in which or on which mixing element/s is/are provided. This insures a uniform action of the mixing elements on the components of the mortar.

Advantageously, at the setting direction end of the anchor member, there is provided means that substantially prevents rotation of the anchor member in the bore.

The mixing elements can be formed, e.g., as ribs, bosses, knobs, vanes provided on the outer surface of the sleeve. The mixing elements can also be formed as openings in the wall of the sleeve. The openings can have an arbitrary shape.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
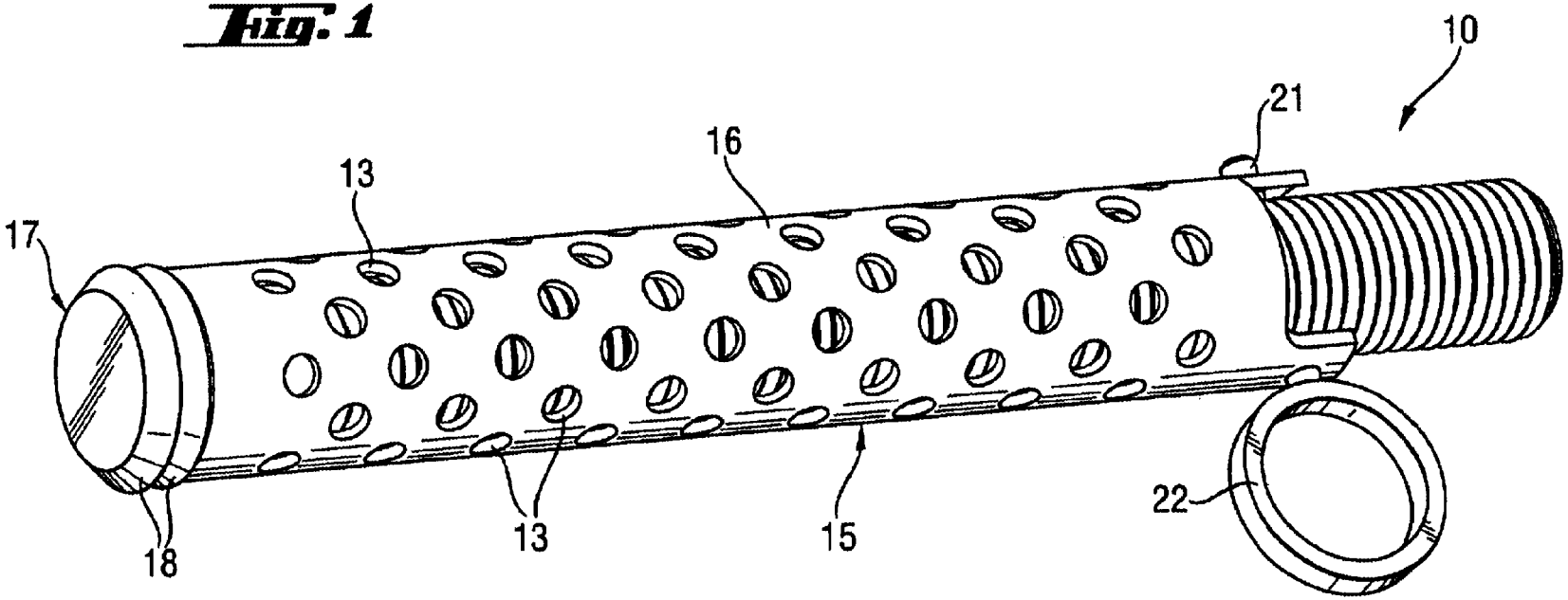
FIG. 1. a perspective view of a first embodiment of an anchor according to the present invention.
Figure 2:
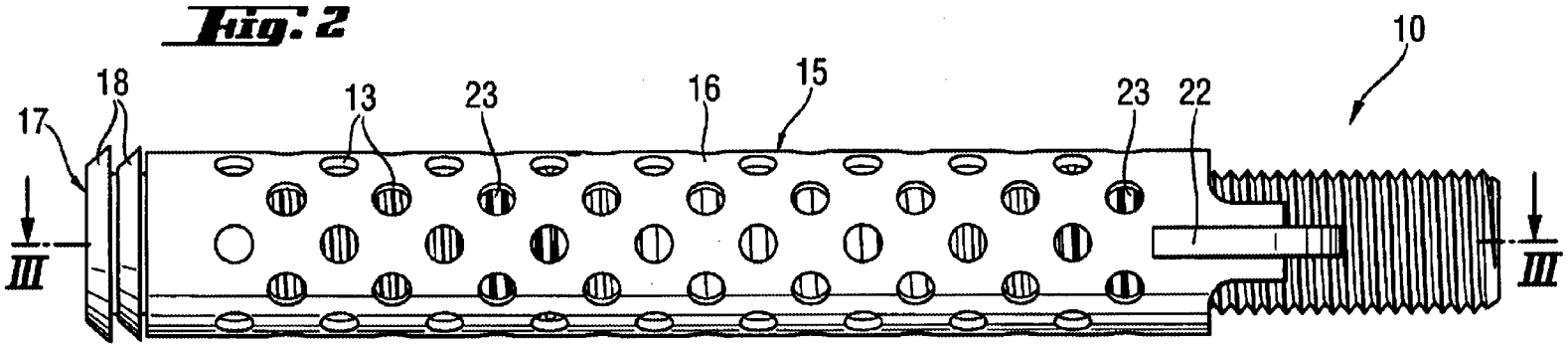
FIG. 2. a side view of the anchor shown in FIG. 1.
Figure 3:
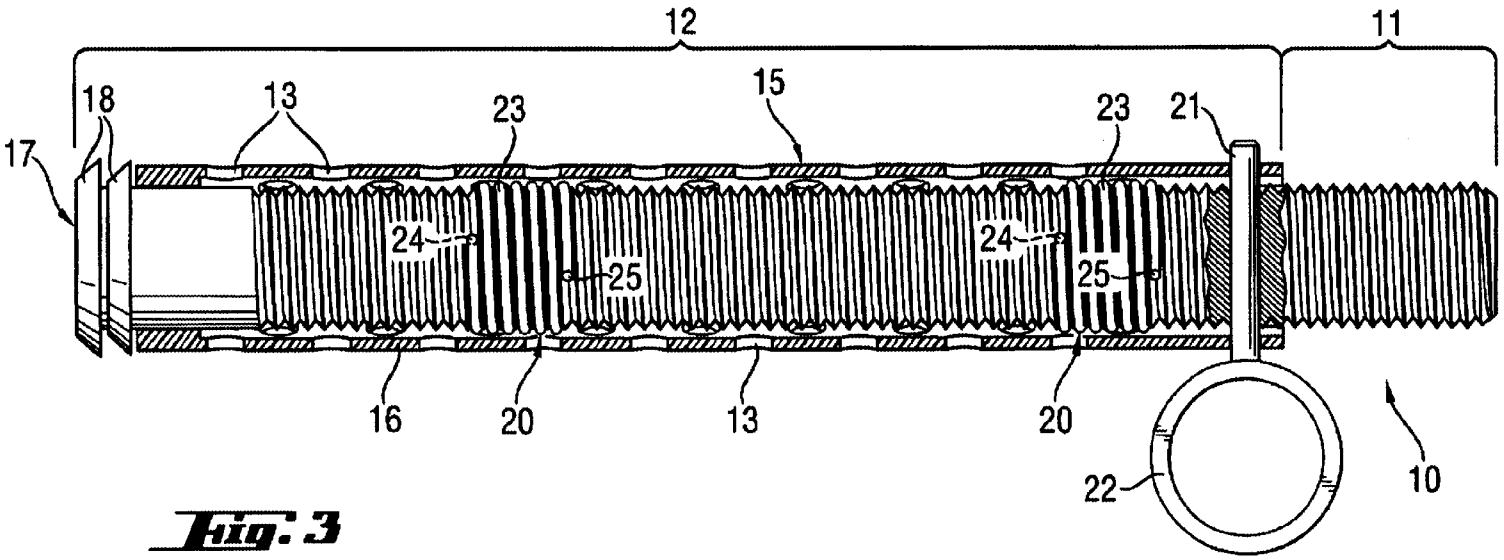
FIG. 3. a longitudinal cross-sectional view along line III—III in FIG. 2.

An anchor 10, a first embodiment of which is shown in FIGS. 1–3, includes an anchor member 12 formed integrally with a load application member 12. With a predetermined use of the anchor 10, when it is anchored in a bore (not shown), the anchor member 12 is completely located in the bore, with the load application member 11 projecting out of the bore so that a structural component can be mounted thereon or attached thereto. The anchor 10 is secured in the bore with a two-or multicomponent mortar that fills the bore. The mortar is placed in the bore, e.g., in a manner described in U.S. Pat. No. 4,655,645.

At the end of the anchor member 12 facing in a setting direction of the anchor 10, there is provided fixing means 17 with circumferentially arranged retaining means 18, e.g., in a form of a circumferential toothing. The fixing means 17 serves for fixing the end region of the anchor 10 in the bore.

The fixing means 18 can likewise be formed integrally with the anchor member 12.

A mixing sleeve 15 is circumferentially arranged around the anchor member 12. Circular openings 13, which are formed in the wall 16 of the mixing sleeve 15, form mixing elements. Between the anchor member 12 and the mixing sleeve 15, there is provided drive means 20 that rotates the mixing sleeve 15 relative to the anchor member 12 upon actuation of trigger means 21.

The drive means 20 contains, in the embodiment shown in FIGS. 1–3, two helical springs 23 supported on the circumferential surface of the anchor member 12 and having their ends 24 secured to the anchor member 12. At their opposite ends 25, the springs 23 are fixedly secured to the mixing sleeve 15. Both helical springs 23 are prestreesed, with the trigger means 21 which prevents the springs 23 from becoming unstressed.

When the trigger means 21, which is formed as a locking pin, is manually withdrawn, by being pulled by its eyelet 22, from the bore in the anchor member 12 and both sides of the mixing sleeve 15, the springs 23 become unstressed, and the mixing sleeve 15, together with the mixing elements 13, begins to rotate about the anchor member 12. When the anchor 10 is being set into a bore, together with reaction components of a mortar mass, the automatic rotation of the mixing sleeve 15 relative to the anchor member 12 provides for mixing of the reaction components of the mortar.

Figure 4:
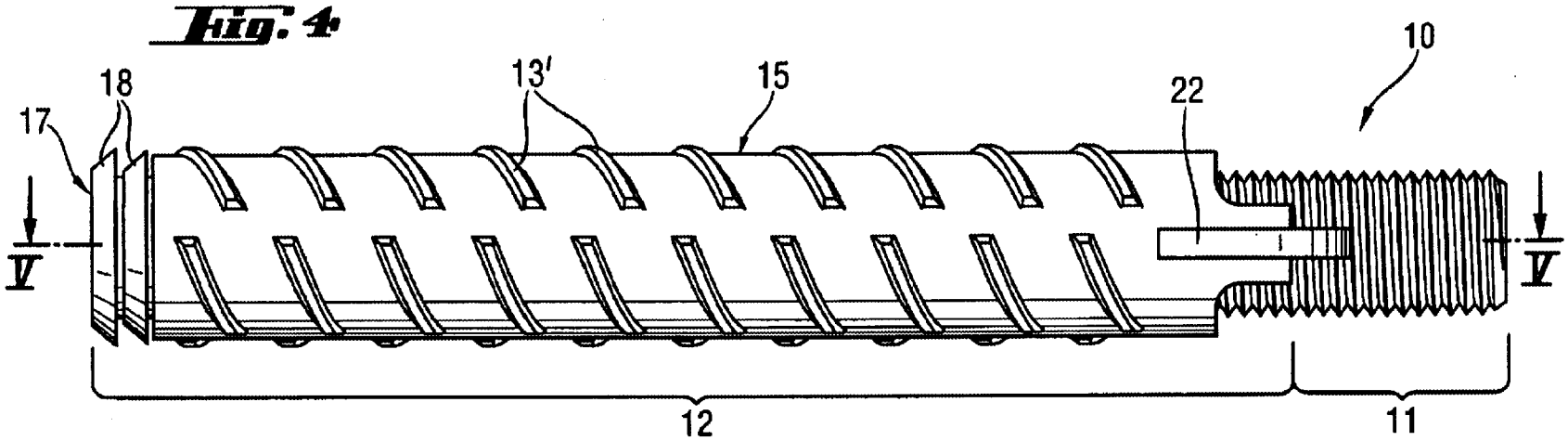
FIG. 4. a perspective view of a second embodiment of an anchor according to the present invention.
Figure 5:
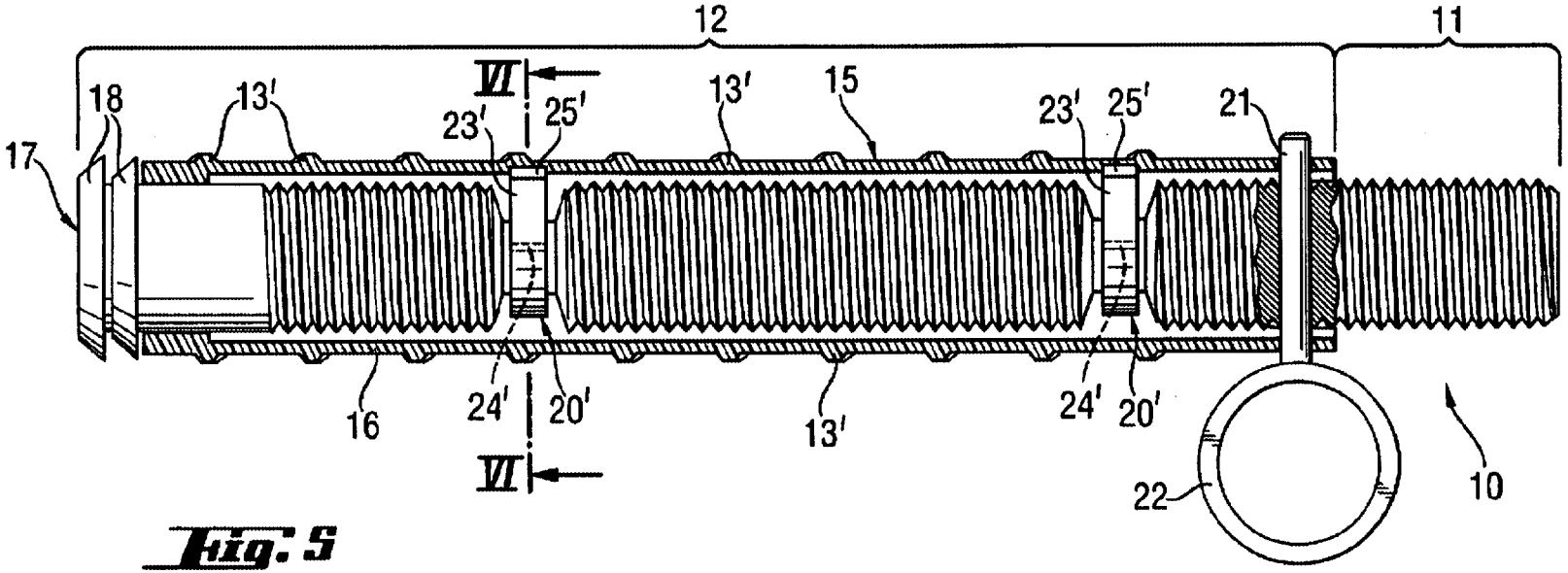
FIG. 5. a longitudinal cross-sectional view along line V—V in FIG. 4.
Figure 6:
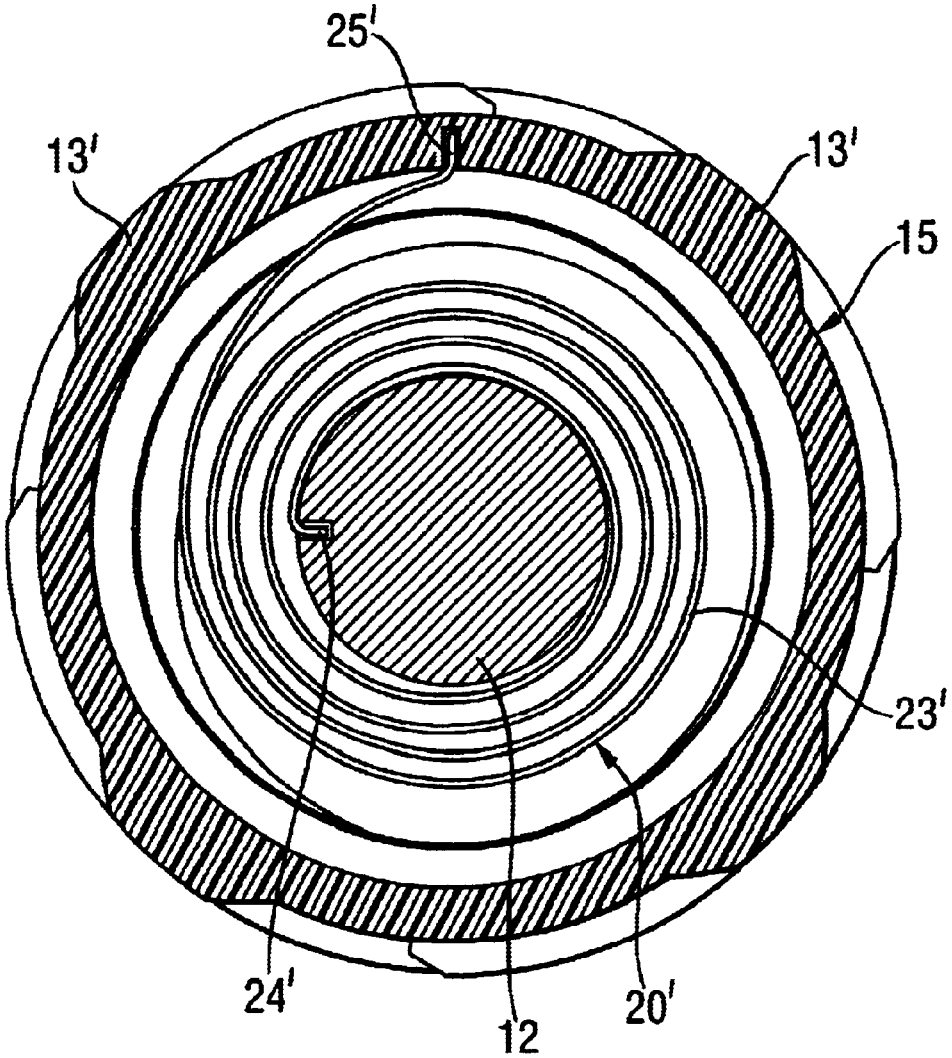
FIG. 6. a cross-sectional view along line VI—VI in FIG. 5.

A second embodiment of the anchor 10, which is shown in FIGS. 4–6, differs from the embodiment shown in FIGS. 1–3 by the following features.

The mixing elements 13', which are provided on the surface of the mixing sleeve 15, are formed as ribs inclined to a vertical. Instead of helical springs, the drive means 20' is formed of two spiral spring 23' arranged on two sections of the anchor member 12 having a reduced diameter. The ends 24' of the spiral springs 23' are fixedly secured to the anchor member 12 in a manner shown in FIG. 6. The opposite ends 25' are secured to the mixing sleeve 15. The drawings show the anchor 10 in its to-be-set condition, with prestressed spiral springs 23'. The securing the springs 23' in their prestress condition and releasing them is effected, as in the embodiment of FIGS. 1–3, with the locking pin 21.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. An anchor securable in a bore with a mortar, comprising an anchor members (12) located in the bore after setting of the anchor; a load application member (11) projecting out of the bore upon the setting of the anchor, at least one mixing element (13, 13') for mixing components of the mortar; drive means (20, 20') provided on the anchor member (12) for setting in motion the at least one mixing element (13, 13'); and trigger means (21) for actuating the drive means (20, 20') and which automatically sets in motion the at least one mixing element (13, 13') upon actuation of the trigger means (21), wherein the drive means (20, 20') includes at least one force accumulator (23, 23') that provides a necessary drive energy for setting in motion the at least one mixing element (13).

2. An anchor according to claim 1, wherein the at least one force accumulator (23, 23') is formed as prestressable spring having one (24, 24') of ends thereof secured to the anchor member (12) and another end (25, 25') is operatively connected with the at least one mixing element (13), the spring providing the drive energy upon becoming unstressed upon actuation of the trigger means (21).

3. An anchor according to claim 2, further comprising sleeve (15) surrounding the anchor member (12) in a spaced relationship thereto and carrying the at least one mixing member (13, 13'), the another end of the spring 24, 24' being secured to the mixing sleeve, whereby the sleeve (15), together with the at least one mixing element (13, 13'), is set in motion upon actuation of the trigger means (21).

4. An anchor according to claim 3, wherein the at least one mixing element (13') is provided on an outer surface of the mixing sleeve (15).

5. An anchor according to claim 3, wherein the at least one mixing element (13) is formed as a bore in a wall of the mixing sleeve (15).

6. An anchor according to claim 1, wherein the force accumulator (23') is formed as a spiral spring.

7. An anchor according to claim 1, wherein the force accumulator (23) is formed as a helical spring.

8. An anchor securable in a bore with a mortar, comprising an anchor member (12) located in the bore after setting of the anchor; a load application member (11) projecting out of the bore upon the setting of the anchor, at least one mixing element (13, 13') for mixing components of the mortar; drive means (20, 20') provided on the anchor member (12) and connected with the at least one mixing element (13, 13') for setting in motion the at least one mixing element (13, 13'); and trigger means (21) for actuating the drive means (20, 20') and which automatically sets in motion the at least one mixing element (13, 13') upon actuation of the trigger means (21).

* * * * *